US006621394B2

(12) United States Patent
Ono et al.

(10) Patent No.: US 6,621,394 B2
(45) Date of Patent: Sep. 16, 2003

(54) ELECTROMAGNETIC RELAY APPARATUS

(75) Inventors: Tsutomu Ono, Ichinoseki (JP); Keiichi Mori, Ichinoseki (JP); Katsuto Kojima, Ichinoseki (JP); Tatsumi Ide, Ichinoseki (JP)

(73) Assignee: NEC Tokin Iwate Ltd., Iwate (JP)

( * ) Notice: Subject to any disclaimer, the term of this patent is extended or adjusted under 35 U.S.C. 154(b) by 0 days.

(21) Appl. No.: 10/217,463

(22) Filed: Aug. 14, 2002

(65) Prior Publication Data

US 2003/0034863 A1 Feb. 20, 2003

(30) Foreign Application Priority Data

Aug. 17, 2001 (JP) ..... 2001-248206

(51) Int. Cl.[7] ..... H01H 67/00; H01H 51/22

(52) U.S. Cl. ..... 335/159; 335/78; 335/119; 335/162

(58) Field of Search ..... 335/78–86, 159–163, 335/106, 107, 119

(56) References Cited

U.S. PATENT DOCUMENTS 4,959,627 A * 9/1990 Iizumi et al. ..... 335/106

5,264,812 A * 11/1993 Tomono et al. ..... 335/78

FOREIGN PATENT DOCUMENTS

JP 2000-315448 11/2000

* cited by examiner

*Primary Examiner*—Ramon M. Barrera
(74) *Attorney, Agent, or Firm*—Young & Thompson

(57) ABSTRACT

An electromagnetic relay apparatus, which is improved in miniaturization, performance, assembly accuracy, cost reduction, productivity, and reliability. A plurality of electromagnetic relays, each having an NO contact that is closed by applying exciting current to a coil and an NC contact that is closed when the excitation current is not passed through the coil, are arranged in line, one diagonally opposite to the next, on a base so that the respective NO/NC contacts of adjacent electromagnetic relays are located in diagonally opposed positions in substantially point symmetrical relation. The electromagnetic relay includes an electromagnetic block having a couple of moving contacts, a first stationary contact and a second stationary contact both being connectable to external wiring, which are composed of uniform parts or components.

50 Claims, 4 Drawing Sheets

ELECTROMAGNETIC RELAY APPARATUS

FIELD OF THE INVENTION

The present invention relates to an electromagnetic relay apparatus structured by using a plurality of electromagnetic blocks such as a twin type electromagnetic relay.

BACKGROUND OF THE INVENTION

There have been utilized electromagnetic relay apparatuses, which comprise a plurality of electromagnetic relays being connected one to another. The electromagnetic relay comprised in the apparatus as a block unit is a switch for opening and closing electric contacts for carrying out inversion control (forward/backward direction control) of a motor or solenoid.

For example, the electromagnetic relay apparatus is adopted for automobiles. Recent automobiles are increasingly equipped with various electrical devices as the result of advances in the miniaturization, high-density mounting and cost reduction of the devices. In other words, the high adoption rate of electrical devices in automobiles can be achieved through development or improvement in the installed devices. Consequently, the electromagnetic relay apparatus requires more miniaturization, cost reduction as well as improvement in reliability, the accuracy of parts assembly, and productivity etc. in the market.

Among such electromagnetic relay apparatuses, there has been disclosed an electromagnetic relay in Japanese Patent Application laid open No. 2000-315448. The electromagnetic relay comprises plural electromagnetic blocks each having two moving contacts that swing up and down by the excitation current flow in a coil, a first stationary terminal having plural first stationary contacts each aligned with respective moving contacts, and a second stationary terminal having plural second stationary contacts each aligned with respective moving contacts.

Each electromagnetic block is provided with a couple of coil terminals each having an end connected to external wiring. The electromagnetic blocks are uniformly oriented and aligned in line. The first stationary terminal has an end connected to external wiring, and is set so that the first stationary contacts are located above the moving contacts. The second stationary terminal also has an end connected to external wiring. The second stationary terminal is set in an orthogonal direction of the arrangement of the electromagnetic blocks in such a manner that the second stationary contacts are located under the moving contacts.

The moving contact is magnetically attracted to the coil and comes in contact with the second stationary contact when current is applied to the coil. When current is not passed through the coil, the moving contact is in contact with the first stationary contact. Accordingly, desired circuits can be opened or closed through respective connecting ends of electromagnetic blocks as well as at the connecting ends of the first and second stationary terminals.

The electromagnetic relay, however, has some problems due to its construction in which uniformly oriented electromagnetic blocks are integrally coupled in aligned and parallel relation, and share the same first and second stationary terminals.

First, the coil terminals of adjacent electromagnetic blocks are disposed in a row at narrow pitch on only one side of the relay. This complicates the layout and wiring of a base.

Secondly, the electromagnetic blocks having the same shape occupy more space when oriented in line as described above. However, it is uneconomical to form the blocks into different shapes so as to efficiently utilize the space in that the respective blocks cannot be composed of uniform parts.

Thirdly, in the above patent application, the electromagnetic blocks are described as being joined, but there is no particular description of how to join the blocks. Assuming that the blocks are joined by using adhesive etc. (considering their shapes, it seems unlikely that the blocks are swaged or bolted together), dimensional distortion or deviation easily occurs. That is, the dimension of the coupled blocks may elongate in the arranging direction. In this case, the first and second stationary terminals, which are bent and formed to the proper dimensions for engagement with the coupled blocks to be fixed thereto, may be unable to accommodate accumulative deviations depending on the number of the blocks joined together. Consequently, it becomes impossible to attach the stationary terminals to the blocks. With this construction, the electromagnetic relay cannot be assembled precisely.

Fourthly, each stationary terminal is provided with a plurality of stationary contacts so that the electromagnetic blocks share the common stationary terminals. As a result, when a stationary contact comes in contact with a moving contact, vibrations set up at the stationary contact are propagated to every stationary contact of the same stationary terminal. That is, a contact on operation easily transmits vibrations to other contacts, which undermines contact reliability. Besides, since the electromagnetic blocks are disposed in side-by-side contacting relation, the electromagnetic relay is structurally liable to allow the propagation of vibrations.

Moreover, in this construction, exothermic heat evolved from passing current concentrates on the contact areas of the stationary terminals, and thus current-carrying performance is deteriorated.

SUMMARY OF THE INVENTION

It is therefore an object of the present invention to provide an electromagnetic relay apparatus, which is improved in size, performance, assembly accuracy, cost, productivity, and reliability.

In accordance with the first aspect of the present invention, to achieve the above objects, there is provided an electromagnetic relay apparatus comprising a plurality of electromagnetic relays each having dual or a couple of moving contacts that swing by the excitation current flow in a coil, a couple of stationary contacts set against the directions of movement of the moving contacts with the moving contacts between them, wherein one of the moving contacts and one of the stationary contacts form a normally open contact (NO contact) which is closed when excitation current is applied to the coil, the other moving contact and the other stationary contact form a normally closed contact (NC contact) which is closed when current is not passed through the coil, and the electromagnetic relays are disposed in line on a base so that the NO/NC contacts of adjacent electromagnetic relays are located in opposed outer positions in substantially point symmetrical relation.

In accordance with the second aspect of the present invention, in the first aspect, the electromagnetic relay has a first stationary terminal that is provided with a first stationary contact forming the NO contact and a second stationary terminal that is provided with a second stationary contact forming the NC contact separately, each being connectable to external wiring.

In accordance with the third aspect of the present invention, in the second aspect, the moving contacts swing upward and downward, and the first and second stationary terminals are set on the base so as to extend from opposite directions at right angles to the directions of movement of the moving contacts, with the first stationary contact being located under the moving contacts and the second stationary contact being located above the moving contacts.

In accordance with the fourth aspect of the present invention, in the third aspect, the electromagnetic relay comprises an electromagnetic block, the first stationary terminal of substantially L-shape having the first stationary contact, and the second stationary terminal of substantially L-shape having the second stationary contact. The electromagnetic block includes a couple of coil terminals, a coil assembly that is formed by winding coil wire connected with the coil terminals around a spool, a yoke of substantially L-shape mounting the coil assembly on its inner basal surface, a cylindrical core extending through the coil assembly to hold the assembly in place, and a moving terminal that is provided with a vertically movable armature extending from the top of the upstanding surface of the yoke over the coil assembly and the moving contacts on both surfaces at the end extending beyond the armature, and is fixed to the outer upstanding surface of the yoke. Besides, a plurality of stationary terminal holders of required height each having substantially an C-shape in a plan view are formed on the base with adjacent stationary terminal holders being located in diagonally opposite positions. The stationary terminal holder supports the first and second stationary terminals so that the terminals extend out from the opposite sides thereof toward each other with the first and second stationary contacts being located one above the other. The electromagnetic block is placed opposite the stationary terminal holder.

In accordance with the fifth aspect of the present invention, in the fourth aspect, the base is formed in a manner so as to have raised portions each forming the stationary terminal holder with adjacent raised portions being coupled at their respective edges of the C.

In accordance with the sixth aspect of the present invention, in the fourth aspect, the base is formed in a manner so as to have separate raised portions each forming the stationary terminal holder.

In accordance with the seventh aspect of the present invention, in the fifth or sixth aspect, a first fitting hole is formed at the lower midpoint of the concave surface of the stationary terminal holder, and the edge of the basal surface of the yoke is fitted in the first fitting hole to attach the electromagnetic block to the base.

In accordance with the eighth aspect of the present invention, in the fifth or sixth aspect, the yoke is formed integral with the base.

In accordance with the ninth aspect of the present invention, in the seventh or eighth aspect, a couple of second fitting holes are oppositely formed in the upper surface of the stationary terminal holder so that the first and second stationary terminals are fitted therein in the direction of downward movement of the moving contacts, and the first and second stationary terminals are fitted partway into the second fitting holes, respectively.

In accordance with the tenth aspect of the present invention, in the seventh or eighth aspect, the first stationary terminal is molded partway in the stationary terminal holder by insert molding, a third fitting hole is formed in the upper surface of the stationary terminal holder so that the second stationary terminal is fitted therein in the direction of downward movement of the moving contacts, and the second stationary terminal is fitted partway into the third fitting hole.

In accordance with the eleventh aspect of the present invention, in the ninth or tenth aspect, the base is molded.

In accordance with the twelfth aspect of the present invention, in the eleventh aspect, the main body of the electromagnetic relay apparatus composed of the electromagnetic relays and the base is provided with a closure cover having an opening in engagement with the base.

In accordance with the thirteenth aspect of the present invention, in the twelfth aspect, the cover is sealed to the main body of the electromagnetic relay apparatus with a thermosetting resin member.

In accordance with the fourteenth aspect of the present invention, in the thirteenth aspect, the electromagnetic relay apparatus comprises a couple of the electromagnetic relays.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENT

Figure 1:
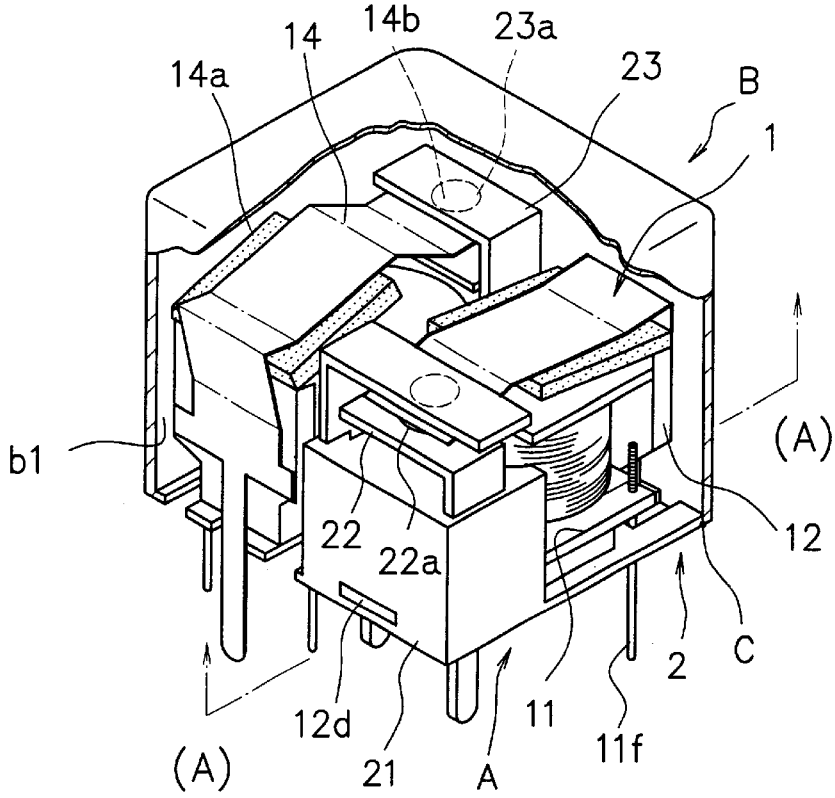
FIG. 1 is a perspective view of an electromagnetic relay apparatus according to an embodiment of the present invention with its cover partially broken away.

Referring now to the drawings, a description of a preferred embodiment of the present invention will be given in detail.

Figure 2:
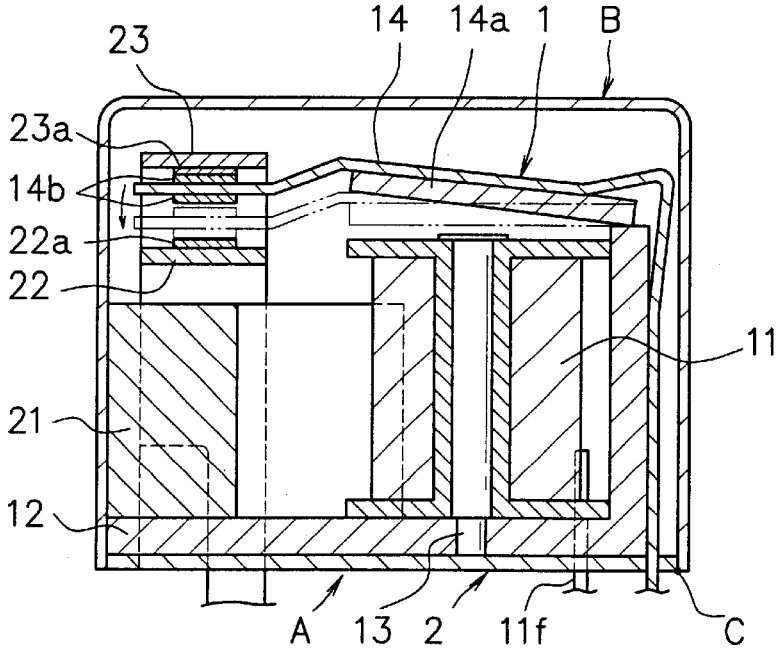
FIG. 2 is a vertical cross-sectional view taken along the line (A)—(A) of FIG. 1.
Figure 3:
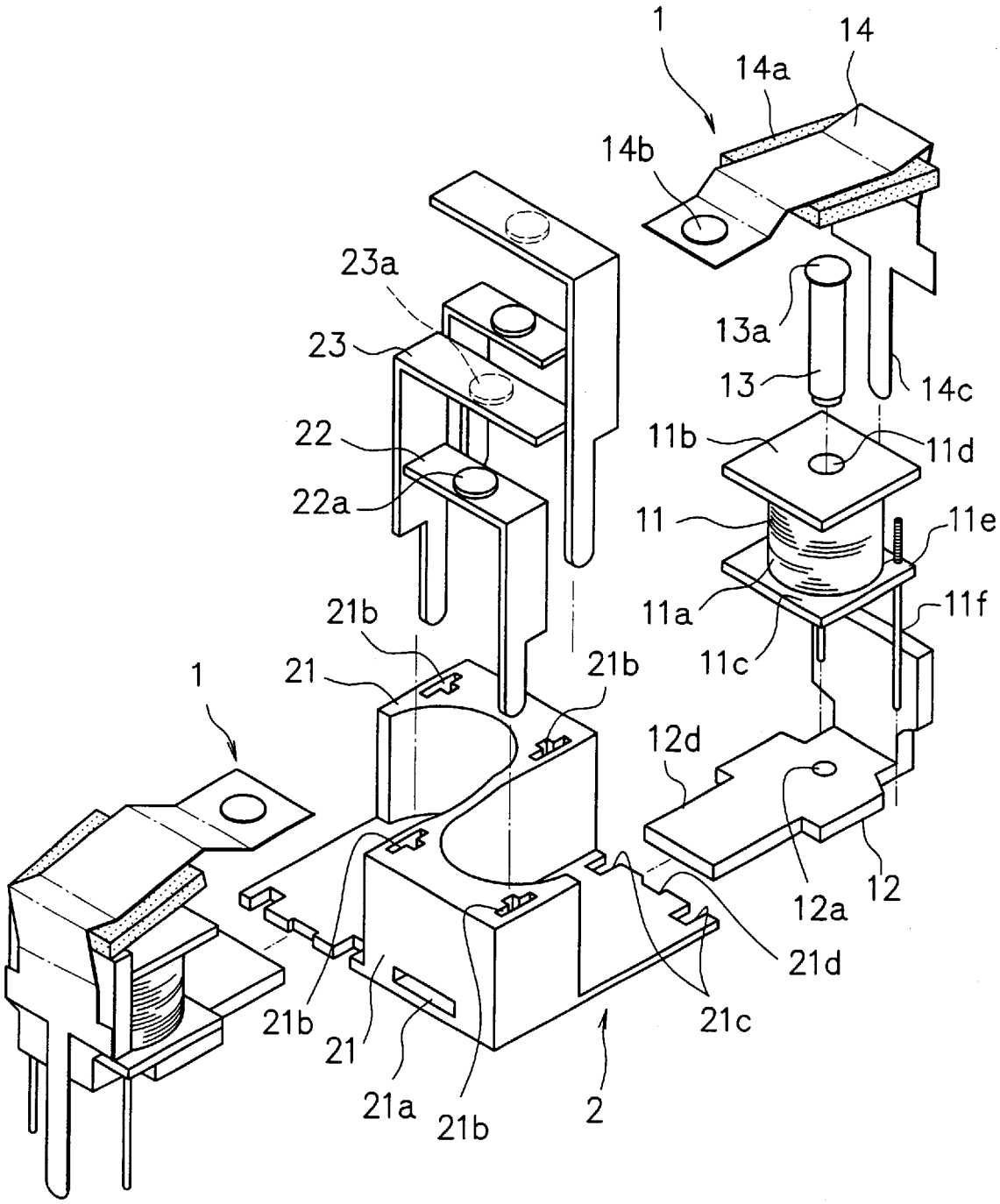
FIG. 3 is an exploded perspective view of the main body of the electromagnetic relay apparatus.

As shown in FIGS. 1 to 3, an electromagnetic relay apparatus according to an embodiment of the present invention consists of a main body A and a cover B for covering the main body A. The main body A is composed of a plurality of electromagnetic relays each having an electromagnetic block 1 with moving contacts, a first stationary terminal 22 and a second stationary terminal 23, and a base or baseblock 2 for holding the electromagnetic relays.

The electromagnetic block 1 comprises a coil assembly 11, a yoke 12, a core 13 and a moving terminal 14.

The coil assembly 11 includes a spool lie with a through hole 11*d* in the center, a coil wire 11*a* wound around the spool 11*e*, and a pair of rod-like coil terminal 11*f*. The spool 11*e* is provided with flanges 11*b* and 11*c* thereon and thereunder, respectively. The coil terminals 11*f* fit in the flange 11*c*. The ends of the coil wire 11*a* are twined around the coil terminals 11*f*, respectively. Incidentally, the coil terminals 11*f* may take the form of a plate.

The yoke 12 is formed of substantially L-shape. The long side of the L, which forms a basal surface, is provided with shoulders, and narrowed from the midpoint to the edge. The basal surface is also shouldered near the intersection of the L so as not to interfere with the coil terminals 11*f*. The broad part of the basal surface mounts the coil assembly 11, and is provided with an engaging hole 12*a* for engagement with the core 13.

The core 13 is a prescribed length of shaft or rod, which has a collar as a head 13*a* and a diametrically reduced shoulder at its lower end. The core 13 is passed through the through hole 11*b* and engaging hole 12*a* to hold the coil assembly 11 on the yoke 12. The shoulder of the core 13 that slightly protrudes from the engaging hole 12*a* is peened against the outer basal surface of the yoke 12 and secured thereto so as to unitize the coil assembly 11 and the yoke 12.

The moving terminal 14 is a conductive band plate member, which is elastically deformable and bent to form substantially an L-shape. A plate armature 14*a*, which is magnetically attracted, is fixed to the middle of the inner (lower) surface of an arm of the L. In addition, dual or a pair of moving contacts 14*b* are set on both upper and lower surfaces of the arm, respectively, near the edge. The moving terminal 14 is fixed to the outer upstanding surface of the yoke 12 so that the armature 14*a* is located directly above the coil assembly 11.

In this construction of the electromagnetic block 1, electromagnetic force is generated in the coil by applying voltage to the coil terminals 11*f*. Accordingly, the armature 14*a* is magnetically attracted to the coil, and thereby resiliently deflecting the moving terminal 14 downward. When cutting off the voltage, the moving terminal 14 resiles by a spring action.

The base (block) 2 is molded with a plurality of raised portions thereon as stationary terminal holders 21. Adjacent stationary terminal holders 21 of substantially C-shape in plan view are arranged in diagonally opposite relation with their respective edges of the C being coupled so as to form substantially an S-shape. The stationary terminal holder 21 is provided with a first fitting hole 21*a* and a couple of second fitting holes 21*b*. The first fitting hole 21*a* is formed at the lower midpoint of the concave side so that the narrowed end of the basal surface of the yoke 12 is fitted therein. The second fitting holes 21*b* are oppositely formed in the upper surface of the stationary terminal holder 21 so as to extend in a vertical downwards direction corresponding to the direction of movement of the moving contacts 14*b*. Besides, the base 2 has a couple of first recesses 21*c* for guiding the coil terminals 11*f* and a second recess 21*d* therebetween for guiding the end of the moving terminal 14 that forms a common terminal 14*c* connected to external wiring, at the edge opposite each stationary terminal holder 21.

The first stationary terminal 22 and second stationary terminal 23 of substantially L-shape are provided with a stationary contacts 22*a* and 23*a*, respectively. The stationary contacts 22*a* and 23*a* form a normally open contact (NO contact) and a normally closed contact (NC contact), respectively, with the moving contacts 14*b* between them. The first stationary terminal 22 is fitted partway into one of the second fitting holes 21*b* so as to extend at right angles to the moving terminal 14 in a plan view. The second stationary terminal 23 is fitted partway into the other second fitting hole 21*b*, and also extends at right angles to the moving terminal 14. That is, the first stationary terminal 22 and second stationary terminal 23 are located in opposed positions and extend toward each other.

A plurality of electromagnetic relays are arranged in line, one diagonally opposite to the next, on the base 2 so that the respective NO/NC contacts, which cause vibrations, of adjacent electromagnetic relays are located in opposed outer positions in substantially point symmetrical relation.

The cover B is a box-shaped closure cover having an opening b1 of approximately the same size as the base 2 that has a clearance fit therein. The interior of the opening b1 is sealed to the periphery of the base 2 with thermosetting resin member C, and thus the cover B is secured to the main body A.

In this embodiment, the upper moving contact 14*b* maintains contact with the upper stationary contact 23*a* to form the NC contact, while the lower moving contact 14*b* is kept out of contact with the lower stationary contact 22*a* to form the NO contact when current is not passed through the coil. By applying current to the coil terminals 11*f*, the moving contact 14*b* makes contact with the stationary contact 22*a*, which opens the NC contact as well as closing the NO contact.

Figure 7:
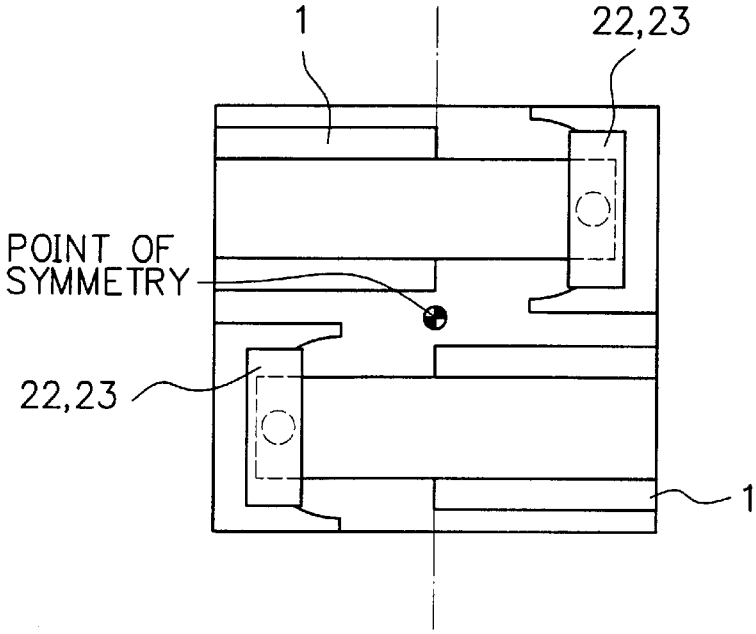
FIG. 7 is a plan view showing a frame format of the main body of the electromagnetic relay apparatus.

As is described above, the electromagnetic relay apparatus of the present invention is provided with the electromagnetic blocks 1 arranged in diagonally opposite relation and the independent first stationary terminal 22 and second stationary terminal 23, which consist of common simple forms of components while maintaining the function of conventional twin type electromagnetic relays. By virtue of this construction, it is possible to minimize or substantially prevent misalignment of the respective contacts resulting from propagated vibrations during operation and the deterioration of current-carrying performance. Further, it can be avoided that the coil terminals 11*f* lines up at narrow pitch on only one side of the main body. Still further, the electromagnetic relay apparatus can be assembled easily and also precisely without any special tools or instruments. In addition, since the electromagnetic relays are oppositely aligned in point symmetrical relation (see FIG. 7), when the electromagnetic relay apparatus is of twin type including two relays, the opening b1 of the cover B does not need to be oriented with respect to the base 2, which even more facilitates the assembly.

Figure 4:
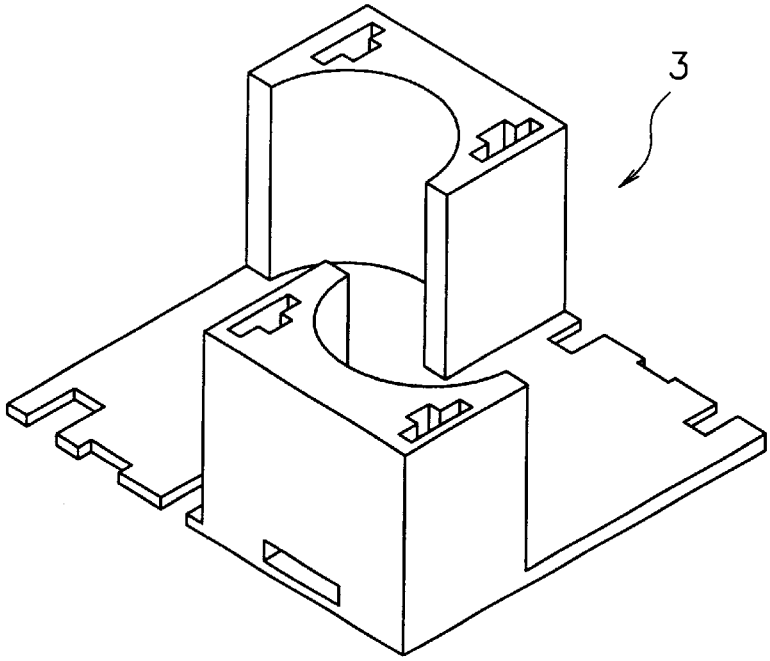
FIG. 4 is a perspective view of a base as a variation.
Figure 5:
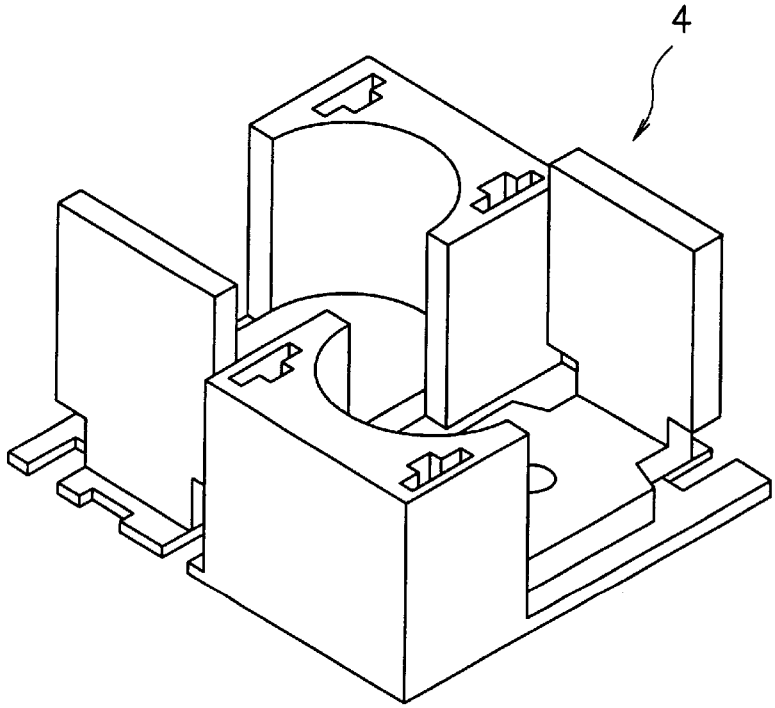
FIG. 5 is a perspective view of a base as another variation.
Figure 6:
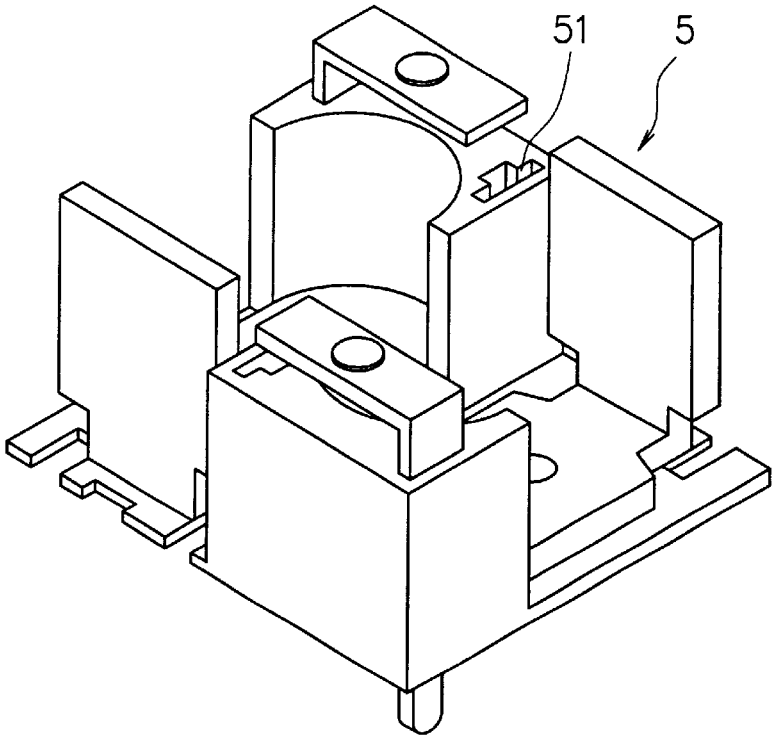
FIG. 6 is a perspective view of a base as yet another variation.

Incidentally, modifications may be made in the above-mentioned base 2 such as, for example, providing separate stationary terminal holders as the base 3 illustrated in FIG. 4 without coupling their edges. As with the base 4 illustrated in FIG. 5, the yoke may be molded integral with the base. Naturally, in this case, there is no need for the fitting hole for placing the yoke on the base (see FIG. 5). To take another example, the first stationary terminal may be molded in the stationary terminal holder by insert molding as the base 5 illustrated in FIG. 6. In this case, the third fitting hole 51 is formed in the upper surface of the stationary terminal holder for fitting the second stationary terminal in the direction of movement of the moving contact (see FIG. 6).

As set forth hereinabove, in accordance with the present invention, a plurality of electromagnetic relays are arranged in line, one diagonally opposite to the next, on a base so that respective NO/NC contacts, which cause vibrations, of adjacent electromagnetic relays are located in opposed outer positions in substantially point symmetrical relation. With this arrangement, it is possible to suppress the propagation of vibrations set up when one of the moving contacts comes in contact with a stationary contact. Additionally, coil terminals are not aligned at narrow pitch on only one side of the main body. In other words, coil terminals are arranged dispersedly. This allows wider lands between respective recesses provided to the base, and increases the freedom of base design for mounting the electromagnetic relays. Thus, the base can be more readily designed and wired. Moreover, because of efficiency in space utilization, parts or components occupy less mounting space, and thus enabling further miniaturization of the electromagnetic relay apparatus Besides, each electromagnetic relay is individually provided with a first stationary terminal having a stationary contact to form a NO contact and a second stationary terminal having a stationary contact to form a NC contact, both of which are connectable to external wiring. Consequently, the effects of vibrations due to the movement of a moving contact, that is, vibrations generated when one of the NO/NC contacts is closed do not directly reach other contacts. Thus, contact reliability can be improved. In addition, differently from the conventional electromagnetic relay apparatus in which electromagnetic relays share common first and second stationary terminals, it is possible to prevent the concentration of exothermic heat evolved from passing current. Accordingly, the current-carrying performance can also be improved.

Furthermore, since the respective electromagnetic relays are composed of uniform or same parts, it is possible to reduce dies and facilities for forming the parts. At the same time, productivity increases and parts assembly can be facilitated.

By forming stationary terminal holders separately, the effects of vibrations due to the movement of a moving contact can be further suppressed.

When yokes are molded integral with the base, the base beneath the yokes can be made thinner. As a result, it is possible to reserve the space wide enough for a coil to obtain necessary turns of wire. In addition, there is no need to press fit the yoke to the base, which dispenses with scrapings that are created by the press fitting.

Similarly, molding the first stationary terminal in the stationary terminal holder by insert molding (integral molding) spares the trouble of the press fitting, and of course, dispenses with scrapings. The integral molding also improves dimensional accuracy and enhances productivity.

Furthermore, the first and second stationary terminals are press fitted into the base correspondingly to the direction of movement of the moving contacts. Therefore, with respect to each electromagnetic block, the penetration depths of the stationary terminals into the base can be adjusted in such a manner as to obtain proper distances between the respective moving contacts and stationary contacts to control contact follow or overtravel: a major characteristic of relays. Thus, stable relaying qualities can be achieved, and the reliability of the electromagnetic relay apparatus is improved.

Furthermore, since the electromagnetic relays are oppositely aligned in point symmetrical relation, when the electromagnetic relay apparatus is of twin type, a cover does not need to be oriented with respect to the base. This facilitates the assembly, and thus leads to better productivity. Additionally, the cover is sealed to the main body by using a thermosetting resin member, the preferable electromagnetic relay apparatus can be produced.

While preferred embodiment of the present invention has been described, it is not to be restricted by the embodiment. It is to be appreciated that those skilled in the art can change or modify the embodiment without departing from the scope and spirit of the following claims.

What is claimed is:

1. An electromagnetic relay apparatus comprising:

a plurality of electromagnetic relays each having a pair of moving contacts that swing by the excitation current flow in a coil, a pair of stationary contacts set against the directions of movement of the moving contacts with the moving contacts between them, wherein one of the moving contacts and one of the stationary contacts form an NO contact which is closed when excitation current is applied to the coil;

the other moving contact and the other stationary contact form an NC contact which is closed when current is not passed through the coil;

the electromagnetic relays are disposed in line on a base so that the NO/NC contacts of adjacent electromagnetic relays are located in opposed outer positions in substantially point symmetrical relation; and the moving contacts swing upward and downward with respect to the base.

2. An electromagnetic relay apparatus comprising:

a plurality of electromagnetic relays each having a pair of moving contacts that swing by the excitation current flow in a coil, a pair of stationary contacts set against the directions of movement of the moving contacts with the moving contacts between them, wherein one of the moving contacts and one of the stationary contacts form an NO contact which is closed when excitation current is applied to the coil;

the other moving contact and the other stationary contact form an NC contact which is closed when current is not passed through the coil;

the electromagnetic relays are disposed in line on a base so that the NO/NC contacts of adjacent electromagnetic relays are located in opposed outer positions in substantially point symmetrical relation;

each electromagnetic relay has a first stationary terminal that is provided with a first stationary contact forming the NO contact and a second stationary terminal that is provided with a second stationary contact forming the NC contact, each being connectable to external wiring; and the first and second stationary terminals are set on the base so as to extend from opposite directions at right angles to the directions of movement of the moving contacts with the first stationary contact being located under the moving contacts and the second stationary contact being located above the moving contacts.

3. An electromagnetic relay apparatus comprising a plurality of electromagnetic relays each having a couple of moving contacts that swing by the excitation current flow in a coil, a couple of stationary contacts set against the directions of movement of the moving contacts with the moving contacts between them, wherein:

one of the moving contacts and one of the stationary contacts form an NO contact which is closed when excitation current is applied to the coil;

the other moving contact and the other stationary contact form an NC contact which is closed when current is not passed through the coil;

the electromagnetic relays are disposed in line on a base so that the NO/NC contacts of adjacent electromagnetic relays are located in opposed outer positions in substantially point symmetrical relation;

the electromagnetic relay has a first stationary terminal that is provided with a first stationary contact forming the NO contact and a second stationary terminal that is provided with a second stationary contact forming the NC contact, each being connectable to external wiring;

the moving contacts swing upward and downward; and the first and second stationary terminals are set on the base so as to extend from opposite directions at right angles to the directions of movement of the moving contacts with the first stationary contact being located under the moving contacts and the second stationary contact being located above the moving contacts.

4. The electromagnetic relay apparatus claimed in claim 3, wherein the electromagnetic relay comprises:

an electromagnetic block including a couple of coil terminals, a coil assembly that is formed by winding coil wire connected with the coil terminals around a spool, a yoke of substantially L-shape mounting the coil assembly on its inner basal surface, a cylindrical core extending through the coil assembly to hold the assembly in place, and a moving terminal provided with a vertically movable armature extending from the top of the upstanding surface of the yoke over the coil assembly and the moving contacts on both surfaces at the end extending beyond the armature, which is fixed to the outer upstanding surface of the yoke;

the first stationary terminal of substantially L-shape having the first stationary contact; and the second stationary terminal of substantially L-shape having the second stationary contact; and wherein:

a plurality of stationary terminal holders of required height each having a C-shape in a plan view are formed on the base with adjacent stationary terminal holders being located in diagonally opposite positions;

the stationary terminal holder supports the first and second stationary terminals so that the terminals extend out from the opposite sides thereof toward each other with the first and second stationary contacts being located one above the other; and the electromagnetic block is placed opposite the stationary terminal holder.

5. The electromagnetic relay apparatus claimed in claim 4, wherein the base is formed in a manner so as to have raised portions each forming the stationary terminal holder with adjacent raised portions being coupled at the edge of the C.

6. The electromagnetic relay apparatus claimed in claim 5, wherein a first fitting hole is formed at the lower midpoint of the concave surface of the stationary terminal holder, and the end of the basal surface of the yoke is fitted in the first fitting hole to attach the electromagnetic block to the base.

7. The electromagnetic relay apparatus claimed in claim 6, wherein:

a couple of second fitting holes are oppositely formed in the upper surface of the stationary terminal holder so that the first and second stationary terminals are fitted therein in a direction corresponding to the direction of movement of the moving contacts; and the first and second stationary terminals are fitted partway into the second fitting holes, respectively.

8. The electromagnetic relay apparatus claimed in claim 7, wherein the base is molded.

9. The electromagnetic relay apparatus claimed in claim 8, wherein the main body of the electromagnetic relay apparatus composed of the electromagnetic relays and the base is provided with a closure cover having an opening in engagement with the base.

10. The electromagnetic relay apparatus claimed in claim 9, wherein the cover is sealed to the main body of the electromagnetic relay apparatus with a thermosetting resin member.

11. The electromagnetic relay apparatus claimed in claim 10, wherein the electromagnetic relay apparatus comprises a couple of the electromagnetic relays.

12. The electromagnetic relay apparatus claimed in claim 6, wherein:

the first stationary terminal is molded partway in the stationary terminal holder by insert molding;

a third fitting hole is formed in the upper surface of the stationary terminal holder so that the second stationary terminal is fitted therein in a direction corresponding to the direction of movement of the moving contacts; and the second stationary terminal is fitted partway into the third fitting hole.

13. The electromagnetic relay apparatus claimed in claim 12, wherein the base is molded.

14. The electromagnetic relay apparatus claimed in claim 13, wherein the main body of the electromagnetic relay apparatus composed of the electromagnetic relays and the base is provided with a closure cover having an opening in engagement with the base.

15. The electromagnetic relay apparatus claimed in claim 14, wherein the cover is sealed to the main body of the electromagnetic relay apparatus with a thermosetting resin member.

16. The electromagnetic relay apparatus claimed in claim 15, wherein the electromagnetic relay apparatus comprises a couple of the electromagnetic relays.

17. The electromagnetic relay apparatus claimed in claim 5, wherein the yoke is formed integral with the base.

18. The electromagnetic relay apparatus claimed in claim 17, wherein:

a couple of second fitting holes are oppositely formed in the upper surface of the stationary terminal holder so that the first and second stationary terminals are fitted therein in a direction corresponding to the direction of movement of the moving contacts; and the first and second stationary terminals are fitted partway into the second fitting holes, respectively.

19. The electromagnetic relay apparatus claimed in claim 18, wherein the base is molded.

20. The electromagnetic relay apparatus claimed in claim 19, wherein the main body of the electromagnetic relay apparatus composed of the electromagnetic relays and the base is provided with a closure cover having an opening in engagement with the base.

21. The electromagnetic relay apparatus claimed in claim 20, wherein the cover is sealed to the main body of the electromagnetic relay apparatus with a thermosetting resin member.

22. The electromagnetic relay apparatus claimed in claim 21, wherein the electromagnetic relay apparatus comprises a couple of the electromagnetic relays.

23. The electromagnetic relay apparatus claimed in claim 17, wherein:

the first stationary terminal is molded partway in the stationary terminal holder by insert molding;

a third fitting hole is formed in the upper surface of the stationary terminal holder so that the second stationary terminal is fitted therein in a direction corresponding to the direction of movement of the moving contacts; and the second stationary terminal is fitted partway into the third fitting hole.

24. The electromagnetic relay apparatus claimed in claim 23, wherein the base is molded.

25. The electromagnetic relay apparatus claimed in claim 24, wherein the main body of the electromagnetic relay apparatus composed of the electromagnetic relays and the base is provided with a closure cover having an opening in engagement with the base.

26. The electromagnetic relay apparatus claimed in claim 25, wherein the cover is sealed to the main body of the electromagnetic relay apparatus with a thermosetting resin member.

27. The electromagnetic relay apparatus claimed in claim 26, wherein the electromagnetic relay apparatus comprises a couple of the electromagnetic relays.

28. The electromagnetic relay apparatus claimed in claim 4, wherein the base is formed in a manner so as to have separate raised portions each forming the stationary terminal holder.

29. The electromagnetic relay apparatus claimed in claim 28, wherein a first fitting hole is formed at the lower midpoint of the concave surface of the stationary terminal holder, and the end of the basal surface of the yoke is fitted in the first fitting hole to attach the electromagnetic block to the base.

30. The electromagnetic relay apparatus claimed in claim 29, wherein:

a couple of second fitting holes are oppositely formed in the upper surface of the stationary terminal holder so that the first and second stationary terminals are fitted therein in a direction corresponding to the direction of movement of the moving contacts; and the first and second stationary terminals are fitted partway into the second fitting holes, respectively.

31. The electromagnetic relay apparatus claimed in claim 30, wherein the base is molded.

32. The electromagnetic relay apparatus claimed in claim 31, wherein the main body of the electromagnetic relay apparatus composed of the electromagnetic relays and the base is provided with a closure cover having an opening in engagement with the base.

33. The electromagnetic relay apparatus claimed in claim 32, wherein the cover is sealed to the main body of the electromagnetic relay apparatus with a thermosetting resin member.

34. The electromagnetic relay apparatus claimed in claim 33, wherein the electromagnetic relay apparatus comprises a couple of the electromagnetic relays.

35. The electromagnetic relay apparatus claimed in claim 29, wherein:

the first stationary terminal is molded partway in the stationary terminal holder by insert molding;

a third fitting hole is formed in the upper surface of the stationary terminal holder so that the second stationary terminal is fitted therein in a direction corresponding to the direction of movement of the moving contacts; and the second stationary terminal is fitted partway into the third fitting hole.

36. The electromagnetic relay apparatus claimed in claim 35, wherein the base is molded.

37. The electromagnetic relay apparatus claimed in claim 36, wherein the main body of the electromagnetic relay apparatus composed of the electromagnetic relays and the base is provided with a closure cover having an opening in engagement with the base.

38. The electromagnetic relay apparatus claimed in claim 37, wherein the cover is sealed to the main body of the electromagnetic relay apparatus with a thermosetting resin member.

39. The electromagnetic relay apparatus claimed in claim 38, wherein the electromagnetic relay apparatus comprises a couple of the electromagnetic relays.

40. The electromagnetic relay apparatus claimed in claim 28, wherein the yoke is formed integral with the base.

41. The electromagnetic relay apparatus claimed in claim 40, wherein:

a couple of second fitting holes are oppositely formed in the upper surface of the stationary terminal holder so that the first and second stationary terminals are fitted therein in a direction corresponding to the direction of movement of the moving contacts; and the first and second stationary terminals are fitted partway into the second fitting holes, respectively.

42. The electromagnetic relay apparatus claimed in claim 41, wherein the base is molded.

43. The electromagnetic relay apparatus claimed in claim 42, wherein the main body of the electromagnetic relay apparatus composed of the electromagnetic relays and the base is provided with a closure cover having an opening in engagement with the base.

44. The electromagnetic relay apparatus claimed in claim 43, wherein the cover is sealed to the main body of the electromagnetic relay apparatus with a thermosetting resin member.

45. The electromagnetic relay apparatus claimed in claim 44, wherein the electromagnetic relay apparatus comprises a couple of the electromagnetic relays.

46. The electromagnetic relay apparatus claimed in claim 40, wherein:

the first stationary terminal is molded partway in the stationary terminal holder by insert molding;

a third fitting hole is formed in the upper surface of the stationary terminal holder so that the second stationary terminal is fitted therein in a direction corresponding to the direction of movement of the moving contacts; and the second stationary terminal is fitted partway into the third fitting hole.

47. The electromagnetic relay apparatus claimed in claim 46, wherein the base is molded.

48. The electromagnetic relay apparatus claimed in claim 47, wherein the main body of the electromagnetic relay apparatus composed of the electromagnetic relays and the base is provided with a closure cover having an opening in engagement with the base.

49. The electromagnetic relay apparatus claimed in claim 48, wherein the cover is sealed to the main body of the electromagnetic relay apparatus with a thermosetting resin member.

50. The electromagnetic relay apparatus claimed in claim 49, wherein the electromagnetic relay apparatus comprises a couple of the electromagnetic relays.

* * * * *